US011854459B2

(12) United States Patent
Wang et al.

(10) Patent No.: US 11,854,459 B2
(45) Date of Patent: Dec. 26, 2023

(54) METHOD FOR DRIVING A PIXEL CIRCUIT

(71) Applicant: YUNGU (GU'AN) TECHNOLOGY CO., LTD., Hebei (CN)

(72) Inventors: Ling Wang, Langfang (CN); Cuili Gai, Langfang (CN); Lei Mi, Langfang (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 17/988,091

(22) Filed: Nov. 16, 2022

(65) Prior Publication Data

US 2023/0083238 A1 Mar. 16, 2023

Related U.S. Application Data

(63) Continuation of application No. PCT/CN2021/103039, filed on Jun. 29, 2021.

(30) Foreign Application Priority Data

Sep. 1, 2020 (CN) ..... 202010905021.3

(51) Int. Cl.
*G09G 3/20* (2006.01)

(52) U.S. Cl.
CPC ..... *G09G 3/2092* (2013.01); *G09G 2310/027* (2013.01); *G09G 2310/0278* (2013.01);
(Continued)

(58) Field of Classification Search
CPC ..... G09G 3/2092; G09G 2310/027; G09G 2310/0278; G09G 2320/0233;
(Continued)

(56) References Cited

U.S. PATENT DOCUMENTS

2011/0254871 A1* 10/2011 Yoo ..... G09G 3/3233 345/77
2015/0154908 A1* 6/2015 Nam ..... G09G 3/3233 345/76

(Continued)

FOREIGN PATENT DOCUMENTS

CN 103236237 A 8/2013
CN 105679236 A 6/2016

(Continued)

OTHER PUBLICATIONS

International Search Report dated Sep. 13, 2021, in International Application No. PCT/CN2021/103039, 6 pages.

(Continued)

*Primary Examiner* — Jose R Soto Lopez
(74) *Attorney, Agent, or Firm* — Maier & Maier, PLLC

(57) ABSTRACT

A method for driving a pixel circuit. The pixel circuit includes a drive transistor. The method includes: acquiring a theoretical threshold voltage of the drive transistor and actual threshold voltages of the drive transistor at a plurality of different gray levels; determining compensation data voltages of the drive transistor at the plurality of different gray levels according to the theoretical threshold voltage of the drive transistor and the actual threshold voltages of the drive transistor at the plurality of different gray levels; and driving the pixel circuit emit light according to the compensation data voltages of the drive transistor at the plurality of different gray levels.

13 Claims, 6 Drawing Sheets

(52) U.S. Cl.
CPC ..... *G09G 2320/0233* (2013.01); *G09G 2320/0257* (2013.01)

(58) Field of Classification Search
CPC ..... G09G 2320/0257; G09G 3/3291; G09G 2300/0819; G09G 2300/0861; G09G 2310/0251; G09G 2320/0285; G09G 2320/0295; G09G 2320/043; G09G 3/3233; G09G 3/30
See application file for complete search history.

(56) References Cited

U.S. PATENT DOCUMENTS

| | | | | |
|---|---|---|---|---|
| 2015/0179103 | A1* | 6/2015 | Tani | G09G 3/20 345/690 |
| 2017/0110052 | A1* | 4/2017 | Kuo | G09G 3/3266 |
| 2017/0169767 | A1* | 6/2017 | Song | G09G 3/3233 |
| 2018/0130418 | A1* | 5/2018 | Zhu | H01L 29/78648 |
| 2018/0211603 | A1* | 7/2018 | Lu | G09G 3/3258 |
| 2018/0330649 | A1* | 11/2018 | Zhu | H10K 59/123 |
| 2019/0206326 | A1* | 7/2019 | Wang | G09G 3/3233 |
| 2020/0126482 | A1* | 4/2020 | Yang | G09G 3/3241 |
| 2020/0143739 | A1* | 5/2020 | Yang | G09G 3/3233 |
| 2020/0265788 | A1* | 8/2020 | Kim | G09G 3/2003 |
| 2021/0104195 | A1* | 4/2021 | Choi | G09G 3/3258 |
| 2021/0134214 | A1* | 5/2021 | Ban | G09G 3/32 |
| 2021/0174740 | A1* | 6/2021 | Qian | G09G 3/3233 |
| 2021/0248943 | A1* | 8/2021 | Kim | G09G 3/20 |
| 2021/0327367 | A1* | 10/2021 | An | G09G 3/3685 |

FOREIGN PATENT DOCUMENTS

| | | | |
|---|---|---|---|
| CN | 107978279 | A | 5/2018 |
| CN | 109215581 | A | 1/2019 |
| CN | 109903726 | A | 6/2019 |
| CN | 109920373 | A | 6/2019 |
| CN | 1100337333 | A | 7/2019 |
| CN | 111179850 | A | 5/2020 |
| CN | 11200281 | A | 11/2020 |

OTHER PUBLICATIONS

Office Action dated Mar. 18, 2022, in Chinese Patent Application No. 202010905021.3, 13 pages.

* cited by examiner

METHOD FOR DRIVING A PIXEL CIRCUIT

CROSS-REFERENCE TO RELATED APPLICATIONS

This is a continuation of International Patent Application No. PCT/CN2021/103039, filed on Jun. 29, 2021, which claims priority to Chinese Patent Application No. 202010905021.3 filed on Sep. 1, 2020, the disclosures of which are incorporated herein by reference in their entireties.

TECHNICAL FIELD

Embodiments of the present application relate to the field of display technology, for example, a method for driving a pixel circuit.

BACKGROUND

A screen circuit of medium or small size generally adopts a 7T1C internal compensation circuit based on low temperature poly-silicon (LTPS) technology. The 7T1C internal compensation circuit is used for compensating the drift of the threshold voltage of a drive transistor to improve the uniformity of a thin-film transistor (TFT).

However, in high-refresh-rate and high-resolution applications, since charging time is short, and the threshold voltage compensation of the drive transistor is insufficient, problems such as uneven brightness and image sticking at a low gray level are prone to occur.

SUMMARY

An embodiment of the present application provides a method for driving a pixel circuit to alleviate problems such as an uneven display and image sticking caused by insufficient charging time and to improve the display effect of a device.

An embodiment of the present application provides a method for driving a pixel circuit. The pixel circuit includes a drive transistor. The method includes that: a theoretical threshold voltage of the drive transistor and actual threshold voltages of the drive transistor at a plurality of different gray levels are acquired; compensation data voltages of the drive transistor at the plurality of different gray levels are determined according to the theoretical threshold voltage of the drive transistor and the actual threshold voltages of the drive transistor at the plurality of different gray levels; and the pixel circuit is driven to emit light according to the compensation data voltages of the drive transistor at the plurality of different gray levels.

An embodiment of the present application provides a method for driving a pixel circuit. The pixel circuit includes a drive transistor. The method includes that: a theoretical threshold voltage of the drive transistor and actual threshold voltages of the drive transistor at a plurality of different gray levels are acquired; compensation data voltages of the drive transistor at the plurality of different gray levels are determined according to the theoretical threshold voltage of the drive transistor and the actual threshold voltages of the drive transistor at the plurality of different gray levels; and the pixel circuit is driven to emit light according to the compensation data voltages. In the schemes provided by this embodiment of the present application, the compensation data voltages of the drive transistor at the plurality of different gray levels are determined according to the theoretical threshold voltage of the drive transistor and the actual threshold voltages of the drive transistor at the plurality of different gray levels. The compensation data voltages of the drive transistor at the plurality of different gray levels are the voltages actually required to be written to the gate of the drive transistor at a plurality of different gray levels corresponding to a high refresh rate of the device; therefore, the pixel circuit is driven to emit light according to the compensation data voltages so that a current difference and a brightness difference caused by the insufficient charging time are overcome. Thus, the problems such as the uneven display and the image sticking are alleviated, and the display effect of the device is improved.

DETAILED DESCRIPTION

Figure 1:
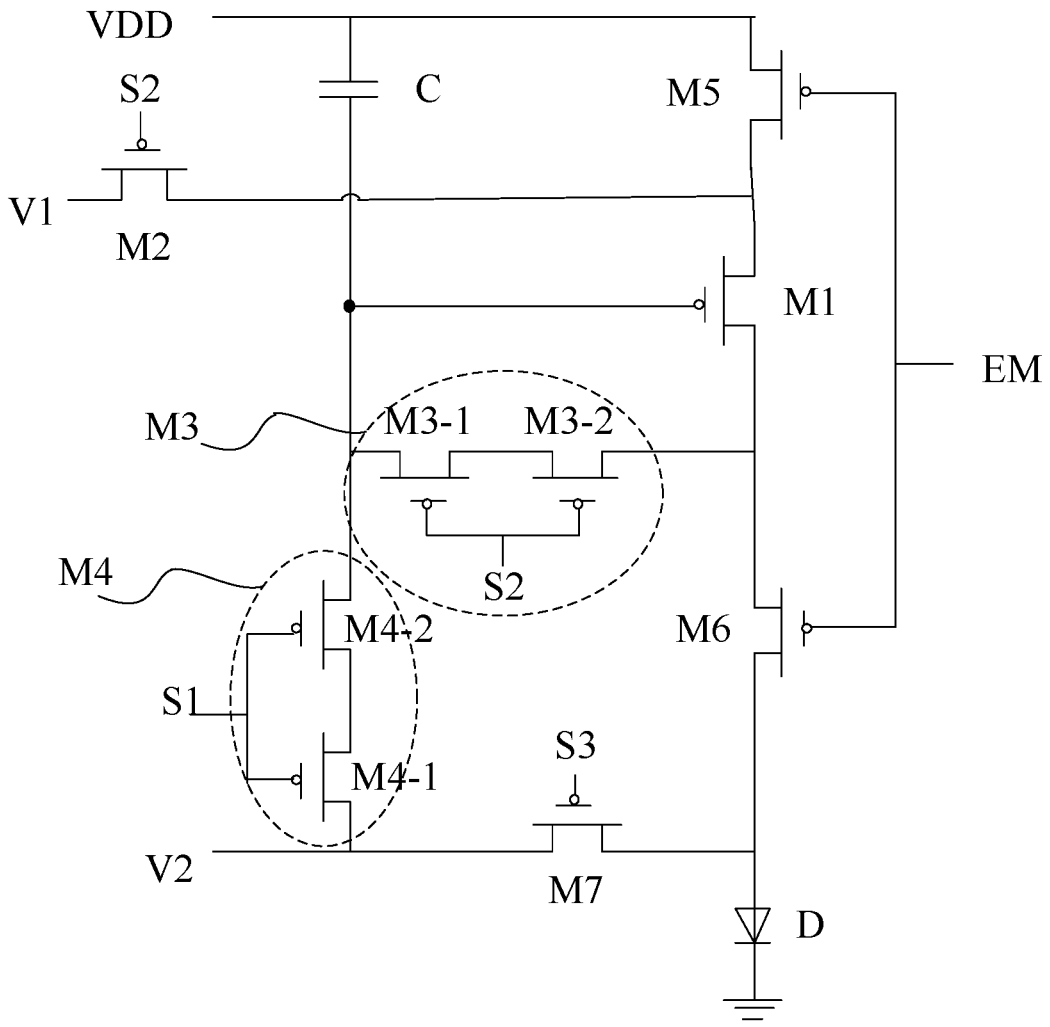
FIG. 1 is a circuit diagram of a pixel circuit.

The present application is described hereinafter in conjunction with drawings and embodiments. The embodiments described herein are intended to explain and not to limit the present application. For ease of description, only part, not all, of the structures related to the present application is illustrated in the drawings.

FIG. 1 is a circuit diagram of a pixel circuit. Referring to FIG. 1, a conventional pixel circuit includes a drive transistor M1, a data voltage write transistor M2, a threshold compensation transistor M3, a first light emission control transistor M5, a second light emission control transistor M6, a first initialization transistor M4, a second initialization transistor M7, a capacitor C and a light emission device D. A first electrode of the data voltage write transistor M2 is electrically connected to a data signal line V1. A second electrode of the data voltage write transistor M2 is electrically connected to a first electrode of the drive transistor M1 and a second electrode of the first light emission control transistor M5. A first electrode of the first light emission control transistor M5 and a first terminal of the capacitor C are electrically connected to a power signal line VDD. A second electrode of the drive transistor M1 is electrically connected to a second electrode of the threshold compensation transistor M3 and a first electrode of the second light emission control transistor M6. A first electrode of the threshold compensation transistor M3 and the gate of the drive transistor M1 are electrically connected to a second terminal of the capacitor C and a first electrode of the first initialization transistor M4. A second electrode of the first initialization transistor M4 and a first electrode of the second initialization transistor M7 are electrically connected to a reference signal line V2. A second electrode of the second light emission control transistor M6 and a second electrode of the second initialization transistor M7 are electrically connected to the light emission device D. The gate of the first light emission control transistor M5 and the gate of the second light emission control transistor M6 are electrically connected to a light emission control signal line EM. The gate of the data voltage write transistor M2 and the gate of the threshold compensation transistor M3 are electrically connected to a second scan signal line S2. The gate of the first initialization transistor M4 is electrically connected to a first scan signal line S1. The gate of the second initialization transistor M7 is electrically connected to a third scan signal line S3. In a data writing and compensation stage, the voltage provided by the data signal line V1 is written to the gate of the drive transistor M1, and the voltage charged in the data writing and compensation stage is maintained on the gate of the drive transistor M1 by the capacitor C. In a light emission stage, the second initialization transistor M7 is controlled to turn on through the third scan signal line S3 to initialize the light emission device D through the reference signal provided by the reference signal line V2, and the first light emission control transistor M5 and the second light emission control transistor M6 are controlled to turn on through the light emission control signal provided by the light emission control signal line EM. Moreover, a first electrode potential of the drive transistor M1 jumps to the potential of the power signal provided by the power signal line VDD. Thus, the drive transistor M1 is turned on. Then the drive transistor M1 forms a driving current according to a gate potential and the potential of the power signal and provides the driving current to the light emission device D. The current flowing through the light emission device D is determined based on the following formula:

$$I \propto \exp\left[\frac{q}{kT}\cdot\left(\frac{V_{GS}-V_T}{n}\right)\right] = \exp\left[\frac{q}{kT}\cdot\left(\frac{(V_{data}+V_T-V_{DD})-V_T}{n}\right)\right].$$

$V_{GS}$ denotes the voltage difference between the gate of the drive transistor M1 and the source of the drive transistor M1. $V_T$ denotes the threshold voltage of the drive transistor M1. $V_{DD}$ denotes the voltage input through the power signal line VDD. $V_{data}$ denotes the data voltage input through the data signal line V1. q, k, T and n denote influence factors. As can be seen from the preceding formula, when the light emission device D emits light, the current flowing through the light emission device D is independent of the threshold voltage $V_T$, that is, the threshold voltage $V_T$ of the drive transistor M1 is compensated. When the pixel circuit operates at a high refresh rate and high resolution, the time of the pixel circuit in the data writing and compensation stage is short, that is, the charging time of the capacitor C electrically connected to the gate of the drive transistor M1 is short. Thus, the threshold voltage acquisition of the drive transistor M1 is insufficient. As a result, the gate potential compensation of the drive transistor M1 in the data writing and compensation stage is insufficient. Similarly, after each gray level voltage is input through the data signal line V1, since the charging time of the gate of the drive transistor M1 is insufficient, there is a certain deviation value between the gate potential of the drive transistor M1 that is actually compensated and the gate potential of the drive transistor M1 that theoretically needs to be compensated. In the light emission stage, the current actually flowing through the light emission device D is:

$$I \propto \exp\left[\frac{q}{kT}\cdot\left(\frac{V_{GS}-V_T}{n}\right)\right] = \exp\left[\frac{q}{kT}\cdot\left(\frac{(V_{data}+V_T-V_{error}-V_{DD})-V_T}{n}\right)\right].$$

$V_{error}$ denotes the deviation value between the theoretical threshold voltage of the drive transistor M1 and the actually compensated threshold voltage of the drive transistor M1 at a gray level. As can be seen from the preceding formula, a difference formed due to the insufficient acquisition of the threshold voltage of the drive transistor M1 causes a current change of an exponential magnitude. As a result, problems such as poor uniformity of a display image and an image sticking phenomenon are caused, and the display effect of the device is affected.

Figure 2:
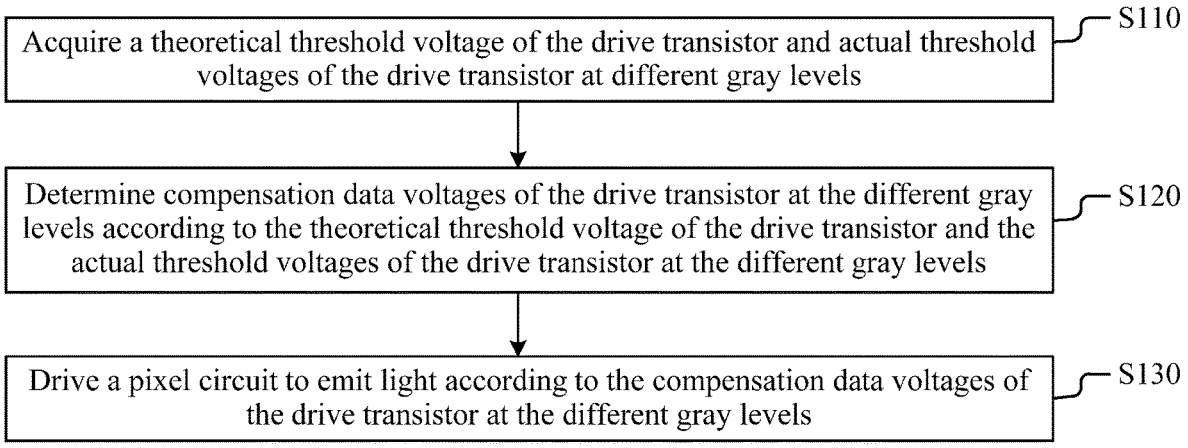
FIG. 2 is a flowchart of a method for driving a pixel circuit according to an embodiment of the present application.

An embodiment of the present application provides a method for driving a pixel circuit. The pixel circuit includes a drive transistor. FIG. 2 is a flowchart of a method for driving a pixel circuit according to an embodiment of the present application. Referring to FIG. 2, this method includes the steps below.

In S110, a theoretical threshold voltage of the drive transistor and actual threshold voltages of the drive transistor at different gray levels are acquired.

The theoretical threshold voltage of the drive transistor may be a corresponding threshold voltage after the characteristic of the drive transistor is determined. During the operation of the pixel circuit, if the theoretical threshold voltage of the drive transistor is compensated, the driving current formed by the pixel circuit may be independent of the threshold voltage of the drive transistor. The theoretical threshold voltage of the drive transistor may be computed on the premise that a preset voltage is written to the gate of the drive transistor and maintained for sufficient compensation time. For example, when the theoretical threshold voltage of the drive transistor of the pixel circuit in a display device such as a mobile phone is acquired, the theoretical threshold voltage may be acquired when the mobile phone is turned off or in a standby state. The actual threshold voltages of the drive transistor at different gray levels may be the difference values between the gate potentials of the drive transistor written by the pixel circuit at the data writing and compensation stage and the gray level voltages when the pixel circuit is driven by the gray level voltages corresponding to different gray levels. In the case where the pixel circuit operates at a high refresh rate or high resolution, the pixel circuit cannot fully achieve threshold compensation of the drive transistor in the data writing and compensation stage. At this time, the actual compensation value for the threshold voltage of the drive transistor of the pixel circuit is the actual threshold voltage of the drive transistor. A gray level refers to a representation in terms of a bright and dark contrast and a black-and-white transition, that is, the brightness level relationship between the darkest black of a display to the brightest white of the display. The gray level may generally be determined according to the power of 2. For example, the gray level may be the eighth power of 2, that is, gray level 256.

In S120, compensation data voltages of the drive transistor at the different gray levels are determined according to the theoretical threshold voltage of the drive transistor and the actual threshold voltages of the drive transistor at the different gray levels.

Gray level voltages at different gray levels are different. In the data writing and compensation stage, a pixel driving circuit charges the gate of the drive transistor differently at different gray level voltages. Thus, the actual threshold voltages of the drive transistor acquired at different gray levels are different. After the actual threshold voltages of the drive transistor at different gray levels are acquired, the compensation data voltage of the drive transistor at a corresponding gray level may be acquired according to the theoretical threshold voltage of the drive transistor and the actual threshold voltages of the drive transistors at different gray levels. The compensation data voltage may compensate the difference value between the theoretical threshold voltage of the drive transistor and the actual threshold voltage of the drive transistor. When data writing and compensation are performed on the pixel circuit by the compensation data voltage, a difference caused by the insufficient acquisition of the threshold voltage of the drive transistor in the related art may be canceled out. Thus, problems such as uneven display and image sticking are alleviated, and the display effect of the device is improved.

In S130, the pixel circuit is driven to emit light according to the compensation data voltages of the drive transistor at the different gray levels.

After the compensation data voltages at different gray levels are obtained by using deviation values of threshold voltages at different gray levels, an obtained compensation data voltage at one gray level is written to the gate of the drive transistor. The pixel circuit is driven to emit light according to a compensation data voltage at one gray level. At this time, the current in the pixel circuit is as follows:

$$I \propto \exp\left[\frac{q}{kT}\cdot\left(\frac{V_{GS}-V_T}{n}\right)\right] = \exp\left[\frac{q}{kT}\cdot\left(\frac{(V_{data_new}+V_T-V_{error}-V_{DD})-V_T}{n}\right)\right]$$
$$= \exp\left[\frac{q}{kT}\cdot\left(\frac{(V_{data_old}+V_{error}+V_T-V_{error}-V_{DD})-V_T}{n}\right)\right]$$
$$= \exp\left[\frac{q}{kT}\cdot\left(\frac{(V_{data_old}+V_T-V_{DD})-V_T}{n}\right)\right].$$

$V_{data_old}$ denotes an original compensation data voltage of the drive transistor at a gray level. $V_{error}$ denotes a deviation value of a threshold voltage of the drive transistor at a gray level. $V_{data_new}$ denotes a compensation data voltage of the drive transistor at a gray level.

As can be seen from the formula, in computation, the deviation value of the threshold voltage introduced in the compensation data voltage may cancel the difference caused by the insufficient acquisition of the threshold voltage of the drive transistor in the related art. In this manner, the pixel circuit is driven to emit light according to the compensation data voltage so that a current difference and a brightness difference caused by insufficient charging time are overcome. Moreover, the problems such as the uneven display and the image sticking are alleviated, and the display effect of the device is improved.

In the schemes of this embodiment, the theoretical threshold voltage of the drive transistor and the actual threshold voltages of the drive transistor at different gray levels are acquired to determine the compensation data voltages of the drive transistor at different gray levels. A data voltage provided by the data signal line is corrected to a compensation data voltage in the data writing and compensation stage. The pixel circuit is driven to emit light according to this compensation data voltage. Thus, when the pixel drive circuit is actually driven to operate, the problems such as the current difference and the brightness difference caused by the insufficient charging time can be solved. Moreover, the uneven display and the image sticking phenomenon are alleviated, and the display effect of the device is improved.

Figure 3:
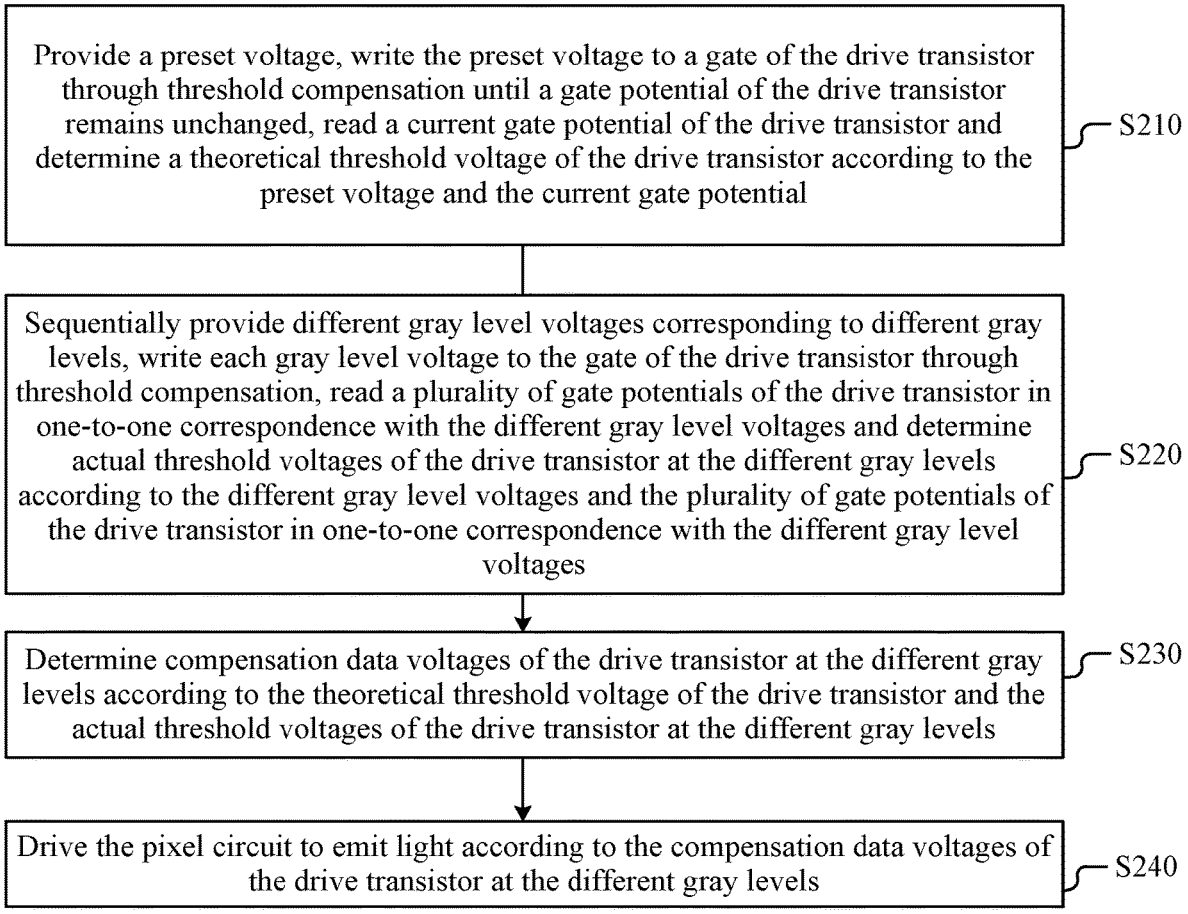
FIG. 3 is a flowchart of another method for driving a pixel circuit according to an embodiment of the present application.

FIG. 3 is a flowchart of another method for driving a pixel circuit according to an embodiment of the present application. Referring to FIG. 3, this method includes the steps below.

In S210, a preset voltage is provided, the preset voltage is written to a gate of the drive transistor through threshold compensation until a gate potential of the drive transistor remains unchanged, a current gate potential of the drive transistor is read and a theoretical threshold voltage of the drive transistor is determined according to the preset voltage and the current gate potential of the drive transistor.

The preset voltage is provided, and the preset voltage is written to the gate of the drive transistor through threshold compensation until the gate potential of the drive transistor remains unchanged. At this time, the drive transistor is sufficiently compensated. The current gate potential of the drive transistor is read on the basis of the sufficient compensation of the drive transistor. The gate of the drive transistor may be connected to an analog-to-digital converter (ADC). The gate potential of the drive transistor is read through the ADC. The theoretical threshold voltage is determined according to the preset voltage written to the gate of the drive transistor and the read current gate potential of the drive transistor.

In S220, different gray level voltages corresponding to different gray levels are provided sequentially, the different gray level voltages are written to the gate of the drive transistor through threshold compensation, a plurality of gate potentials of the drive transistor in one-to-one correspondence with the different gray level voltages are read, and actual threshold voltages of the drive transistor at the different gray levels are determined according to different gray level voltages and the plurality of gate potentials of the drive transistor in one-to-one correspondence with the different gray level voltages.

The step in which different gray level voltages corresponding to different gray levels are provided sequentially, the different gray level voltages are written to the gate of the drive transistor through threshold compensation, a plurality of gate potentials of the drive transistor in one-to-one correspondence with the different gray level voltages are read, actual threshold voltages of the drive transistor at the different gray levels are determined according to the different gray level voltages and the plurality of gate potentials of the drive transistor in one-to-one correspondence with the different gray level voltages includes the steps below. A gray level voltage is provided; the gray level voltage is written to the gate of the drive transistor through threshold compensation; the current gate potential of the drive transistor is read; an actual threshold voltage of the drive transistor at the gray level corresponding to the gray level voltage is determined according to the gray level voltage and the current gate potential of the drive transistor; the following steps are performed repeatedly: a gray level voltage is provided, the gray level voltage is written to the gate of the drive transistor through threshold compensation, the current gate potential of the drive transistor is read, and an actual threshold voltage of the drive transistor at the gray level corresponding to the gray level voltage is determined according to the gray level voltage and the current gate potential of the drive transistor; and a plurality of gray level voltages are sequentially provided to acquire actual threshold voltages of the drive transistor at a plurality of gray levels.

Different gray level voltages corresponding to different gray levels are provided sequentially, and different gray level voltages are written to the gate of the drive transistor through threshold compensation. The compensation time maintained by a gray level voltage written each time may be the time for which a screen is actually lit by a user. Therefore, it is ensured that the compensation time of the gate potential of the drive transistor is equal to the compensation time of the gate potential of the drive transistor in the actual operation of the pixel circuit. Thus, the accuracy of an actual threshold voltage is improved, and the accuracy of the compensation data voltage obtained according to the theoretical threshold voltage and the actual threshold voltage is ensured. The current gate potential of the drive transistor is read on the basis that the compensation time of the drive transistor is the time for which the screen is actually lit by the user. Similarly, the gate of the drive transistor may be connected to the ADC. The gate potential of the drive transistor is read through the ADC. The actual threshold voltage corresponding to a written gray level voltage is determined according to the gray level voltage written to the gate of the drive transistor and the read current gate potential of the drive transistor.

In S230, compensation data voltages of the drive transistor at the different gray levels are determined according to the theoretical threshold voltage of the drive transistor and the actual threshold voltages of the drive transistor at the different gray levels.

Optionally, the step in which the compensation data voltages of the drive transistor at different gray levels are determined according to the theoretical threshold voltage of the drive transistor and the actual threshold voltages of the drive transistor at different gray levels includes the steps below. The difference value between the theoretical threshold voltage of the drive transistor and an actual threshold voltage of the drive transistor at each gray level among the actual threshold voltages of the drive transistor at different gray levels is computed to determine deviation values of threshold voltages of the drive transistor at different gray levels. The compensation data voltages of the drive transistor at different gray levels are determined according to the deviation values of the threshold voltages of the drive transistor at different gray levels.

The difference value between the theoretical threshold voltage of the drive transistor and an actual threshold voltage of the drive transistor at each gray level among the actual threshold voltages of the drive transistor at different gray levels is computed to determine the deviation values of the threshold voltages of the drive transistor at different gray levels. Original compensation data voltages at different gray levels are corrected according to the deviation values of the threshold voltages at different gray levels. That the compensation data voltages of the drive transistor at different gray levels are determined according to the deviation values of the threshold voltages of the drive transistor at different gray levels may be achieved based on the formula: $V_{data_new}=V_{data_old}$ $V_{error}$. $V_{data_old}$ denotes an original compensation data voltage of the drive transistor at a gray level. $V_{error}$ denotes a deviation value of a threshold voltage of the drive transistor at a gray level. $V_{data_new}$ denotes a compensation data voltage of the drive transistor at a gray level. After the deviation values of the threshold voltages at different gray levels are acquired, the original compensation data voltages at different gray levels are corrected according to the deviation values of the threshold voltages, and the compensation data voltages at different gray levels may be obtained.

In S240, the pixel circuit is driven to emit light according to the compensation data voltages of the drive transistor at the different gray levels.

This embodiment of the present application describes the step in which "the theoretical threshold voltage of the drive transistor and the actual threshold voltages of the drive transistor at different gray levels are acquired". That the theoretical threshold voltage of the drive transistor is acquired includes the steps below. A preset voltage is provided, the preset voltage is written to the gate of the drive transistor through threshold compensation until a gate potential of the drive transistor remains unchanged, then a current gate potential of the drive transistor is read and a theoretical threshold voltage of the drive transistor is determined according to the preset voltage and the current gate potential of the drive transistor. That the actual threshold voltages of the drive transistor at different gray levels are acquired includes the steps below. Different gray level voltages corresponding to different gray levels are provided sequentially, the different gray level voltages are written to the gate of the drive transistor through threshold compensation, a plurality of gate potentials of the drive transistor in one-to-one correspondence with the different gray level voltages are read, and the actual threshold voltages of the drive transistor at different gray levels are determined according to the different gray level voltages and the plurality of gate potentials of the drive transistor in one-to-one correspondence with the different gray level voltages. The pixel circuit is driven to emit light according to the compensation data voltages determined by the actual threshold voltages and different gray level voltages to solve the current difference and the brightness difference caused by the insufficient charging time. Thus, the problems such as the uneven display and the image sticking are alleviated, and the display effect of the device is improved.

Figure 4:
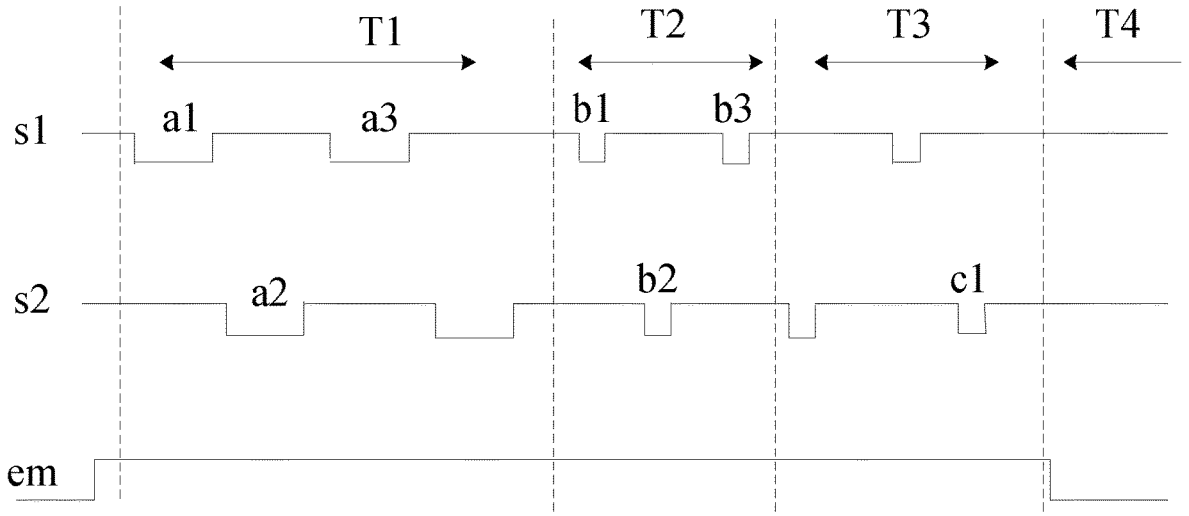
FIG. 4 is a drive timing diagram of the pixel circuit shown in FIG. 1 according to an embodiment of the present disclosure.

FIG. 4 is a drive timing diagram of the pixel circuit shown in FIG. 1 according to an embodiment of the present disclosure. Referring to FIGS. 4 and 1, s1 denotes a scan signal provided by the first scan signal line S1, s2 denotes a scan signal provided by the second scan signal line S2, and em denotes a light emission control signal provided by the light emission control signal line EM. The pixel circuit adopts a conventional 7T1C circuit. The reference signal line V2 may be used as a sensing signal line to be connected to the ADC and to read the gate voltage of the drive transistor M1 in the sensing stage of external compensation. The acquisition of the theoretical threshold voltage of the drive transistor M1 and the actual threshold voltages of the drive transistor M1 at different gray levels is completed in an external compensation stage. The external compensation stage includes a long-term external compensation stage T1 and a short-term external compensation stage T2. The theoretical threshold voltage of the drive transistor M1 needs to be computed on the premise that a preset voltage is written to the gate of the drive transistor M1 and maintained for sufficient compensation time, that is, the acquisition of the theoretical threshold voltage of the drive transistor M1 is completed in the long-term external compensation stage T1. The actual threshold voltage of the drive transistor M1 needs to be computed on the premise that a gray level voltage is written to the gate of the drive transistor M1 and that maintained compensation time is the time for which the screen is actually lit by the user, that is, the acquisition of the actual threshold voltage of the drive transistor M1 is completed in the short-term external compensation stage T2. The acquisition of the actual threshold voltages at multiple gray levels needs to correspond to multiple short-term external compensation stages T2.

Figure 5:
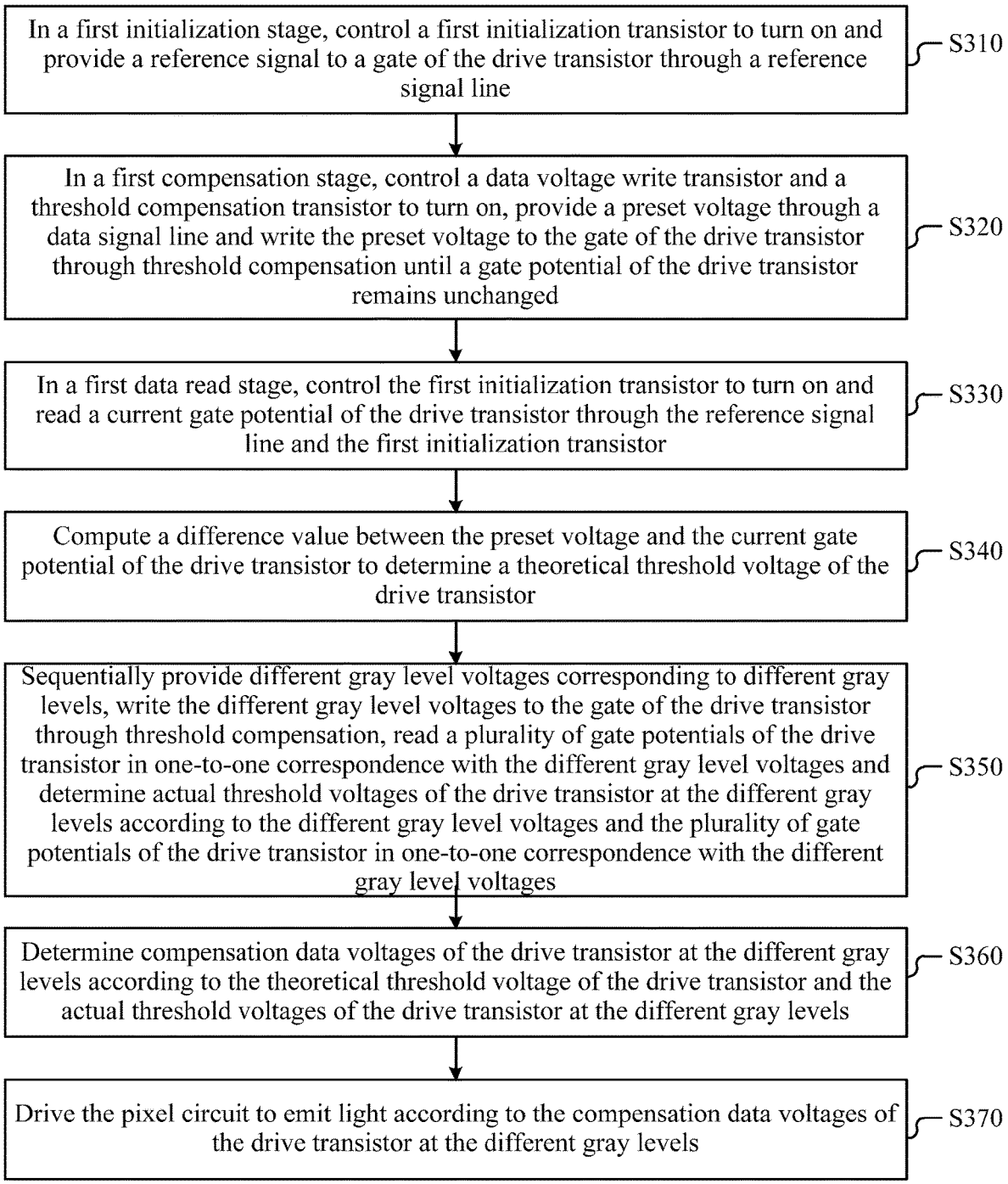
FIG. 5 is a flowchart of another method for driving a pixel circuit according to an embodiment of the present application.

FIG. 5 is a flowchart of another method for driving a pixel circuit according to an embodiment of the present application. Referring to FIG. 5, this method includes the steps below.

In S310, in a first initialization stage, a first initialization transistor is controlled to turn on, and a reference signal is provided to a gate of the drive transistor through a reference signal line.

Referring to FIGS. 1 and 4, if the transistors in the pixel circuit are P-type field effect transistors, a transistor is turned on when the signal input to the gate of the transistor is a low level. If the transistors in the pixel drive circuit are N-type field effect transistors, a transistor is turned on when the signal input to the gate of the transistor is a high level. For example, the transistors in FIG. 1 are all P-type field effect transistors. In the first initialization stage a1, a low level is input through the first scan signal line S1 to turn on the first initialization transistor M4. At this time, one reference signal may be input through the reference signal line V2 to reset the gate potential of the drive transistor M1 so that the accuracy of the theoretical threshold voltage acquired in the long-term external compensation stage T1 is ensured and the accuracy of a compensation data voltage is improved. Thus, the current difference and the brightness difference caused by the insufficient charging time are solved. Moreover, the problems such as the uneven display and the image sticking are alleviated, and the display effect of the device is improved.

In S320, in a first compensation stage, a data voltage write transistor and a threshold compensation transistor are controlled to turn on, a preset voltage is provided through a data signal line, and the preset voltage is written to the gate of the drive transistor through threshold compensation until a gate potential of the drive transistor remains unchanged.

Referring to FIGS. 1 and 4, the second scan signal line S2 is connected to a time control line. The signal clock (SCK) on the time control line is used as the scan signal provided by the second scan signal line. The first compensation stage a2 is a compensation stage in the long-term external compensation stage T1. In this compensation stage, the pulse width of the SCK on the time control line may be adjusted to obtain a scan signal waveform having long pulse time, that is, a waveform having long compensation time is achieved. In the first compensation stage a2, a low level is input through the second scan signal line S2, and the data voltage write transistor M2 and the threshold compensation transistor M3 are turned on. At this time, the drive transistor M1 is equivalent to one diode. A preset voltage written through the data signal line V1 sequentially flows through the data voltage write transistor M2, the first electrode and second electrode of the drive transistor M1 and the threshold compensation transistor M3 to the gate of the drive transistor M1. Since the time in which the low level is input through the second scan signal line S2 is long enough, a gate potential may be compensated until the gate potential remains unchanged.

In S330, in a first data read stage, the first initialization transistor is controlled to turn on, and a current gate potential of the drive transistor is read through the reference signal line and the first initialization transistor.

Referring to FIGS. 1 and 4, the first data read stage a3 is a sensing stage and also belongs to the long-term external compensation stage T1. In the first data read stage a3, a low level is input through the first scan signal line S1, and thus the first initialization transistor M4 is turned on. At this time, the reference signal line V2 is used as the sensing signal line to be connected to the ADC. A gate potential is transmitted to the ADC by the first initialization transistor M4 and through the sensing signal line. The gate potential of the drive transistor M1 is read through the ADC.

In S340, a difference value between the preset voltage and the current gate potential of the drive transistor is computed to determine a theoretical threshold voltage of the drive transistor.

The ADC may transmit the read gate potential of the drive transistor to a driver chip. The theoretical threshold voltage is determined based on the formula $V_o=V_1-V_{ini}$ by the driver chip according to a preset voltage written through the data signal line V1 and the read current gate potential. $V_o$ denotes the theoretical threshold voltage. $V_1$ denotes the read gate potential of the drive transistor M1 in the first data read stage a3. $V_{ini}$ denotes a preset voltage written through the data signal line V1 in the first compensation stage a2.

In S350, different gray level voltages corresponding to different gray levels are provided sequentially, the different gray level voltages are written to the gate of the drive transistor through threshold compensation, a plurality of gate potentials of the drive transistor in one-to-one correspondence with the different gray level voltages are read, and actual threshold voltages of the drive transistor at the different gray levels are determined according to the different gray level voltages and the plurality of gate potentials of the drive transistor in one-to-one correspondence with the different gray level voltages.

In S360, compensation data voltages of the drive transistor at the different gray levels are determined according to the theoretical threshold voltage of the drive transistor and the actual threshold voltages of the drive transistor at the different gray levels.

In S370, the pixel circuit is driven to emit light according to the compensation data voltages of the drive transistor at the different gray levels.

This embodiment of the present application describes the steps in which "a preset voltage is provided, the preset voltage is written to the gate of the drive transistor through threshold compensation until a gate potential of the drive transistor remains unchanged, a current gate potential of the drive transistor is read, and a theoretical threshold voltage of the drive transistor is determined according to the preset voltage and the current gate potential of the drive transistor". Through the compatibility with the pixel circuit and the gate in panel (GIP) circuit in the related art, long-term compensation of the drive transistor until the gate potential remains unchanged can be achieved simply by an adjustment of SCK timing. The reference signal line is used as the sensing signal line to be connected to the analog-to-digital converter. A gate potential is transmitted to the ADC through the sensing signal line. The current gate potential of the drive transistor is read through the ADC. The difference value between a preset voltage written through the data signal line and the current gate potential of the drive transistor is computed to achieve the determination of the theoretical threshold voltage of the drive transistor.

Figure 6:
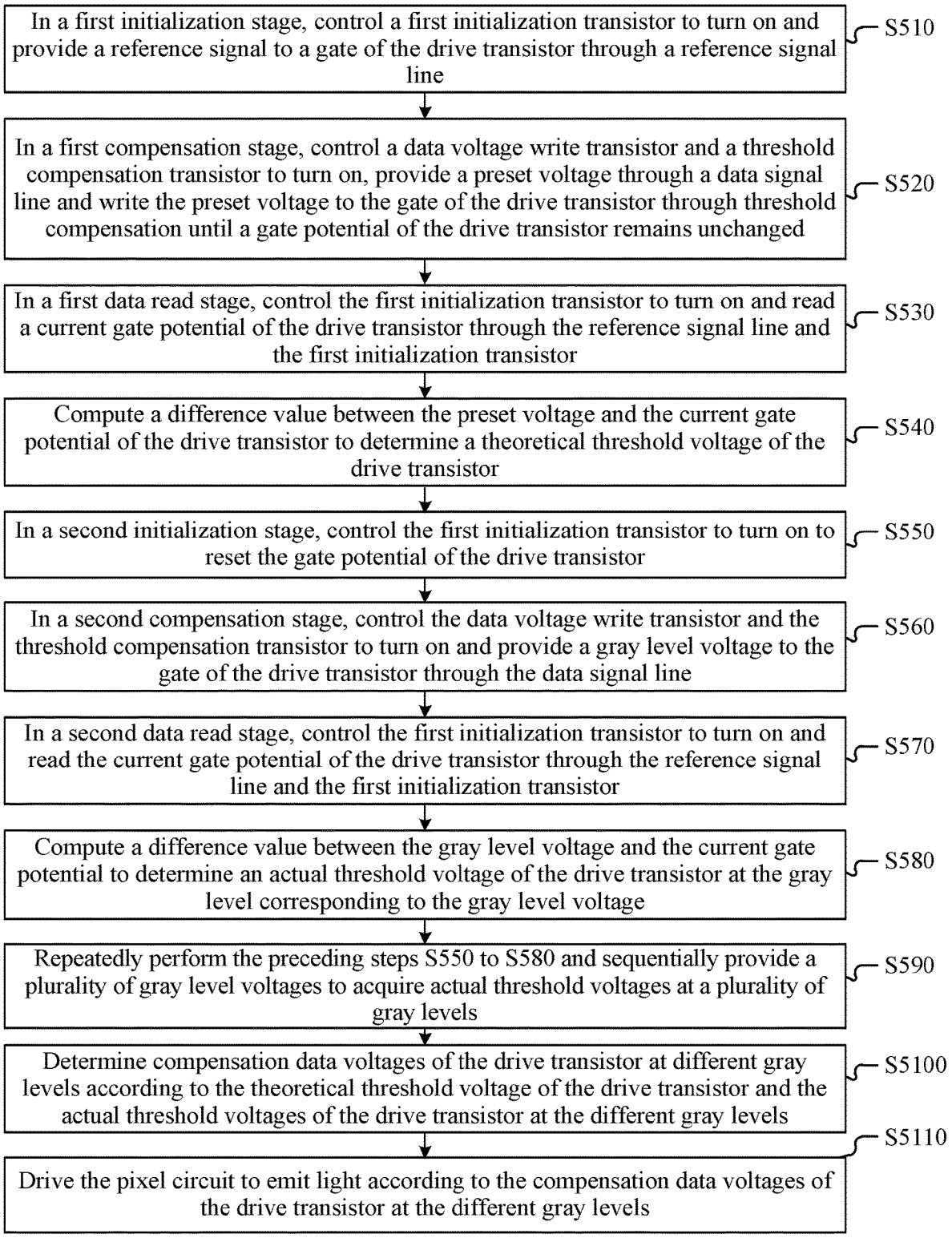
FIG. 6 is a flowchart of another method for driving a pixel circuit according to an embodiment of the present application.

FIG. 6 is a flowchart of another method for driving a pixel circuit according to an embodiment of the present application. Referring to FIG. 6, the method includes the steps below.

In S510, in a first initialization stage, a first initialization transistor is controlled to turn on, and a reference signal is provided to a gate of the drive transistor through a reference signal line.

In S520, in a first compensation stage, a data voltage write transistor and a threshold compensation transistor are controlled to turn on, a preset voltage is provided through a data signal line, and the preset voltage is written to the gate of the drive transistor through threshold compensation until a gate potential of the drive transistor remains unchanged.

In S530, in a first data read stage, the first initialization transistor is controlled to turn on, and a current gate potential of the drive transistor is read through the reference signal line and the first initialization transistor.

In S540, a difference value between the preset voltage and the current gate potential of the drive transistor is computed to determine a theoretical threshold voltage of the drive transistor.

In S550, in a second initialization stage, the first initialization transistor is controlled to turn on to reset the gate potential of the drive transistor.

Referring to FIGS. 1 and 4, in the second initialization stage b1, a low level is input through the first scan signal line S1, and the first initialization transistor M4 is controlled to turn on to reset the gate potential of the drive transistor M1. In this manner, the accuracy of the actual threshold voltage acquired in the short-term external compensation stage T2 is ensured, and the accuracy of the compensation data voltage is improved. Thus, the current difference and the brightness difference caused by the insufficient charging time are solved. Moreover, the problems such as the uneven display and the image sticking are alleviated, and the display effect of the device is improved.

In S560, in a second compensation stage, the data voltage write transistor and the threshold compensation transistor are controlled to turn on, and a gray level voltage is provided to the gate of the drive transistor through the data signal line.

In the second compensation stage b2, a low level is input through the second scan signal line S2, and the data voltage write transistor M2 and the threshold compensation transistor M3 are controlled to turn on. A gray level voltage is provided to the gate of the drive transistor M1 through the data signal line V1. Similarly, the pulse width of the SCK on the time control line may be adjusted to obtain a scan signal waveform having short pulse time. Thus, the compensation time maintained by a written gray level voltage is the time for which the screen is actually lit by the user. Therefore, it is ensured that the compensation time of the gate potential of the drive transistor is equal to the compensation time of the gate potential of the drive transistor in the actual operation of the pixel circuit.

In S570, in a second data read stage, the first initialization transistor is controlled to turn on, and the current gate potential of the drive transistor is read through the reference signal line and the first initialization transistor.

In the second data read stage b3, a low level is input through the first scan signal line S1, and the first initialization transistor M4 is controlled to turn on. The current gate potential of the drive transistor M1 is read through the reference signal line V2 and the first initialization transistor M4. At this time, the reference signal line V2 is used as the sensing signal line to be connected to the ADC. A gate potential is transmitted to the ADC by the first initialization transistor M4 through the sensing signal line. The gate potential of the drive transistor M1 is read through the ADC.

In S580, a difference value between the gray level voltage and the current gate potential is computed to determine an actual threshold voltage of the drive transistor at the gray level corresponding to the gray level voltage.

Step S580 is consistent with step S340, and the details are not repeated here.

In S590, the preceding steps S550 to S580 are repeatedly performed, and a plurality of gray level voltages are sequentially provided to acquire actual threshold voltages at a plurality of gray levels.

The data signal line sequentially provides different gray level voltages corresponding to different gray levels to acquire the actual threshold voltages at a plurality of gray levels. For example, the gray level voltages of five classic gray levels GL255, GL128, GL64, GL32 and GL0 may be sequentially written through the data signal line. The compensation data voltages corresponding to the five gray levels are obtained through the comparison between the actual threshold voltages at the five gray levels and the theoretical threshold voltage obtained in the long-term external compensation stage.

In S5100, compensation data voltages of the drive transistor at different gray levels are determined according to the theoretical threshold voltage of the drive transistor and the actual threshold voltages of the drive transistor at the different gray levels.

In S5110, the pixel circuit is driven to emit light according to the compensation data voltages of the drive transistor at the different gray levels.

In this embodiment of the present application, the manner of obtaining an actual threshold voltage during short-term external compensation is the same as the manner of obtaining the theoretical threshold voltage during long-term external compensation. The difference is that compensation time is different. Similarly, short-term external compensation of the drive transistor can be achieved simply by an adjustment of SCK timing. The preceding steps S550 to S580 are repeatedly performed. The gray level voltages of five classic gray levels (GLs) GL255, GL128, GL64, GL32 and GL0 are sequentially provided to obtain the actual threshold voltages corresponding to the five gray levels. The pixel circuit is driven to emit light according to the compensation data voltages corresponding to the five gray levels to solve the problems such as the current difference and the brightness difference caused by the insufficient charging time at different gray levels. Thus, the problems such as the uneven display and the image sticking are alleviated, and the display effect of the device is improved.

Figure 7:
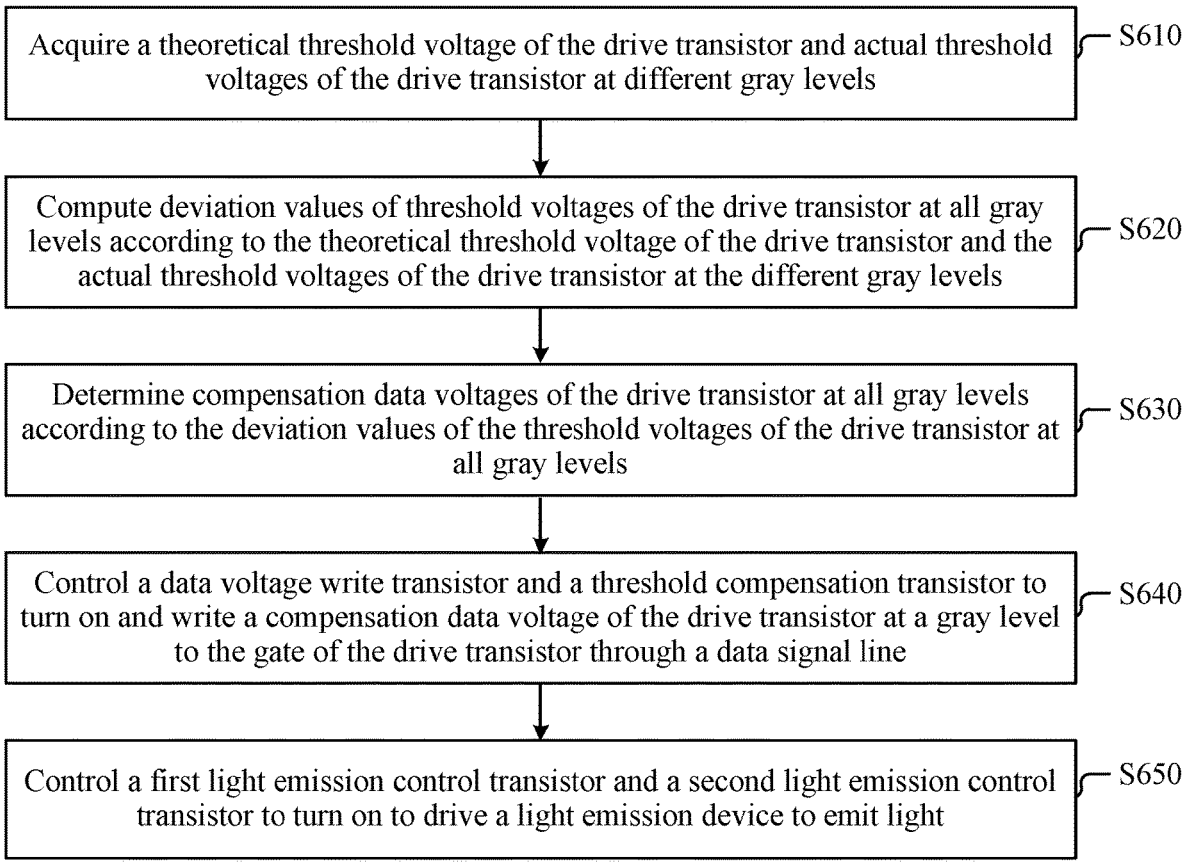
FIG. 7 is a flowchart of another method for driving a pixel circuit according to an embodiment of the present application.

FIG. 7 is a flowchart of another method for driving a pixel circuit according to an embodiment of the present application. Referring to FIG. 7, the method includes the steps below.

In S610, a theoretical threshold voltage of the drive transistor and actual threshold voltages of the drive transistor at different gray levels are acquired.

In S620, deviation values of threshold voltages of the drive transistor at all gray levels are computed according to the theoretical threshold voltage of the drive transistor and the actual threshold voltages of the drive transistor at the different gray levels.

The correspondence relationship between gray level voltages and actual threshold voltages of the drive transistor may be determined according to a plurality of gray level voltages and a plurality of actual threshold voltages of the drive transistor in one-to-one correspondence with the plurality of gray level voltages. For example, the gray level voltages of five classic gray levels GL255, GL128, GL64, GL32 and GL0 are sequentially provided to obtain the actual threshold voltages corresponding to the five gray levels. The correspondence relationship curve between gray level voltages and actual threshold voltages of the drive transistor is fitted according to five classic gray level voltages and a plurality of actual threshold voltages of the drive transistor in one-to-one correspondence with the five classic gray level voltages. The actual threshold voltages of the drive transistor at all gray levels are obtained according to the correspondence relationship curve between the gray level voltages and the actual threshold voltages of the drive transistor. Thus, the deviation values of the threshold voltages of the drive transistor at all gray levels are computed according to the theoretical threshold voltage of the drive transistor and the actual threshold voltages of the drive transistor at all gray levels.

In S630, compensation data voltages of the drive transistor at all gray levels are determined according to the deviation values of the threshold voltages of the drive transistor at all gray levels.

In S640, a data voltage write transistor and a threshold compensation transistor are controlled to turn on, and a compensation data voltage of the drive transistor at a gray level is written to the gate of the drive transistor through a data signal line.

The corrected compensation data voltages $V_{data_new}$ corresponding to all gray levels are stored in a memory, for example, a flash memory card. In the pixel circuit shown in FIG. 1, internal compensation and light emission are performed. Referring to FIG. 4, in an internal compensation stage T3, for example, in a stage cl, a low level is output through the second scan signal line S2, and the data voltage write transistor M2 and the threshold compensation transistor M3 are controlled to turn on. The compensation data voltage of the drive transistor at a gray level is written to the gate of the drive transistor M1 through the data signal line V1.

In S650, a first light emission control transistor and a second light emission control transistor are controlled to turn on to drive a light emission device to emit light.

In the light emission stage T4, a low level is output through the light emission control signal line EM, and the first light emission control transistor M5 and the second light emission control transistor M6 are controlled to turn on to drive the light emission device D to emit light. The deviation values of the threshold voltages at all gray levels during actual internal compensation are acquired through external compensation. The compensation data voltage corresponding to the obtained deviation value of the threshold voltage of the drive transistor at a gray level is used to correct a gray level voltage input through the data signal line to solve the current difference and the brightness difference caused by the insufficient charging time. For example, an uneven display in high-refresh-rate and high-resolution applications can be solved. Thus, the problems such as the uneven display and the image sticking are alleviated, and the display effect of the device is improved.

In the method provided by this embodiment of the present application, after the difference value between the theoretical threshold voltage of the drive transistor and an actual threshold voltage at each gray level among the actual threshold voltages at different gray levels is computed to determine the deviation values of the threshold voltages of the drive transistor at different gray levels, the method further includes the step below. The deviation values of the threshold voltages of the drive transistor at all gray levels are computed according to the difference value between the theoretical threshold voltage of the drive transistor and the actual threshold voltages of the drive transistor at a plurality of gray levels. The step in which "the pixel circuit is driven to emit light according to the compensation data voltages of the drive transistor at different gray levels" is described in combination with the timing diagram and the circuit diagram. The deviation values of the threshold voltages of the drive transistor at all gray levels are computed according to the theoretical threshold voltage of the drive transistor and the actual threshold voltages of the drive transistor at all gray levels. In this manner, the compensation data voltages of the drive transistors at all gray levels are obtained, and a data voltage written through the data signal line is compensated. Thus, the current difference and the brightness difference caused by the insufficient charging time at all gray levels are solved. Moreover, the problems such as the uneven display and the image sticking are alleviated, and the display effect of the device is improved.

What is claimed is:

1. A method for driving a pixel circuit, wherein the pixel circuit comprises a drive transistor, and the method comprises:

acquiring a theoretical threshold voltage of the drive transistor and actual threshold voltages of the drive transistor at a plurality of different gray levels;

determining compensation data voltages of the drive transistor at the plurality of different gray levels according to the theoretical threshold voltage of the drive transistor and the actual threshold voltages of the drive transistor at the plurality of different gray levels;

driving the pixel circuit to emit light according to the compensation data voltages of the drive transistor at the plurality of different gray levels, providing a preset voltage, writing the preset voltage to a gate of the drive transistor through threshold compensation until a gate potential of the drive transistor remains unchanged, reading a current gate potential of the drive transistor and determining the theoretical threshold voltage of the drive transistor according to the preset voltage and the current gate potential of the drive transistor; and providing a plurality of different gray level voltages corresponding to the plurality of different gray levels sequentially, writing the plurality of different gray level voltages to the gate of the drive transistor through the threshold compensation, reading a plurality of gate potentials of the drive transistor in one-to-one correspondence with the plurality of different gray level voltages and determining the actual threshold voltages of the drive transistor at the plurality of different gray levels according to the plurality of different gray level voltages and the plurality of gate potentials of the drive transistor in one-to-one correspondence with the plurality of different gray level voltages.

2. The method according to claim 1, wherein the pixel circuit further comprises a data voltage write transistor, a threshold compensation transistor, a first light emission control transistor, a second light emission control transistor, a first initialization transistor, a second initialization transistor, a capacitor and a light emission device, wherein a first electrode of the data voltage write transistor is electrically connected to a data signal line, and a second electrode of the data voltage write transistor is electrically connected to a first electrode of the drive transistor and a second electrode of the first light emission control transistor; a first electrode of the first light emission control transistor and a first terminal of the capacitor are electrically connected to a power signal line; a second electrode of the drive transistor is electrically connected to a second electrode of the threshold compensation transistor and a first electrode of the second light emission control transistor; a first electrode of the threshold compensation transistor and the gate of the drive transistor are electrically connected to a second terminal of the capacitor and a first electrode of the first initialization transistor; a second electrode of the first initialization transistor and a first electrode of the second initialization transistor are electrically connected to a reference signal line; a second electrode of the second light emission control transistor and a second electrode of the second initialization transistor are electrically connected to the light emission device; a gate of the first light emission control transistor and a gate of the second light emission control transistor are electrically connected to a light emission control signal line; a gate of the data voltage write transistor and a gate of the threshold compensation transistor are electrically connected to a second scan signal line; and a gate of the first initialization transistor is electrically connected to a first scan signal line; and wherein providing the preset voltage, writing the preset voltage to the gate of the drive transistor through the threshold compensation until the gate potential of the drive transistor remains unchanged, reading the current gate potential of the drive transistor and determining the theoretical threshold voltage of the drive transistor according to the preset voltage and the current gate potential of the drive transistor comprise:

in a first compensation stage, controlling the data voltage write transistor and the threshold compensation transistor to turn on, providing the preset voltage through the data signal line and writing the preset voltage to the gate of the drive transistor through the threshold compensation until the gate potential of the drive transistor remains unchanged;

in a first data read stage, controlling the first initialization transistor to turn on and reading the current gate potential of the drive transistor through the reference signal line and the first initialization transistor; and computing a difference value between the preset voltage and the current gate potential of the drive transistor to determine the theoretical threshold voltage of the drive transistor.

3. The method according to claim 2, before the first compensation stage, the method further comprising:

in a first initialization stage, controlling the first initialization transistor to turn on and providing a reference signal to the gate of the drive transistor through the reference signal line.

4. The method according to claim 2, wherein providing the plurality of different gray level voltages corresponding to the plurality of different gray levels sequentially, writing the plurality of different gray level voltages to the gate of the drive transistor through the threshold compensation, reading the plurality of gate potentials of the drive transistor in one-to-one correspondence with the plurality of different gray level voltages and determining the actual threshold voltages of the drive transistor at the plurality of different gray levels according to the plurality of different gray level voltages and the plurality of gate potentials of the drive transistor in one-to-one correspondence with the plurality of different gray level voltages comprise:

providing one gray level voltage of the plurality of different gray level voltages, writing the one gray level voltage to the gate of the drive transistor through the threshold compensation, reading the current gate potential of the drive transistor and determining an actual threshold voltage of the drive transistor at a gray level corresponding to the one gray level voltage according to the one gray level voltage and the current gate potential of the drive transistor; and repeatedly performing the step of determining the actual threshold voltage of the drive transistor at the gray level corresponding to the one gray level voltage and sequentially providing a plurality of gray level voltages to acquire actual threshold voltages of the drive transistor at a plurality of gray levels.

5. The method according to claim 4, wherein providing the one gray level voltage of the plurality of different gray level voltages, writing the one gray level voltage to the gate of the drive transistor through the threshold compensation, reading the current gate potential of the drive transistor and determining the actual threshold voltage of the drive transistor at the gray level corresponding to the one gray level voltage according to the one gray level voltage and the current gate potential of the drive transistor comprise:

in a second initialization stage, controlling the first initialization transistor to turn on to reset a gate potential of the drive transistor;

in a second compensation stage, controlling the data voltage write transistor and the threshold compensation transistor to turn on and providing the one gray level voltage to the gate of the drive transistor through the data signal line;

in a second data read stage, controlling the first initialization transistor to turn on and reading the current gate potential of the drive transistor through the reference signal line and the first initialization transistor; and computing a difference value between the one gray level voltage and the current gate potential of the drive transistor to determine the actual threshold voltage of the drive transistor at the gray level corresponding to the one gray level voltage.

6. The method according to claim 1, wherein determining the compensation data voltages of the drive transistor at the plurality of different gray levels according to the theoretical threshold voltage of the drive transistor and the actual threshold voltages of the drive transistor at the plurality of different gray levels comprises:

computing a difference value between the theoretical threshold voltage of the drive transistor and an actual threshold voltage of the drive transistor at each gray level among the actual threshold voltages of the drive transistor at the plurality of different gray levels to determine deviation values of threshold voltages of the drive transistor at the plurality of different gray levels; and determining the compensation data voltages of the drive transistor at the plurality of different gray levels according to the deviation values of the threshold voltages of the drive transistor at the plurality of different gray levels.

7. The method according to claim 6, wherein determining the compensation data voltages of the drive transistor at the plurality of different gray levels according to the deviation values of the threshold voltages of the drive transistor at the plurality of different gray levels is achieved based on the following formula:

$$V_{data_new}=V_{data_old}+V_{error}, \text{ wherein}$$

$V_{data_old}$ denotes an original compensation data voltage of the drive transistor at one gray level of the plurality of different gray levels, $V_{error}$ denotes a deviation value of a threshold voltage of the drive transistor at the one gray level, and $V_{data_new}$ denotes a compensation data voltage of the drive transistor at the one gray level.

8. The method according to claim 1, after acquiring the theoretical threshold voltage of the drive transistor and the actual threshold voltages of the drive transistor at the plurality of different gray levels, the method further comprising:

computing deviation values of threshold voltages of the drive transistor at all gray levels according to the theoretical threshold voltage of the drive transistor and the actual threshold voltages of the drive transistor at the plurality of different gray levels;

wherein determining the compensation data voltages of the drive transistor at the plurality of different gray levels according to the theoretical threshold voltage of the drive transistor and the actual threshold voltages of the drive transistor at the plurality of different gray levels comprises:

determining compensation data voltages of the drive transistor at all the gray levels according to the theoretical threshold voltage of the drive transistor and actual threshold voltages of the drive transistor at all the gray levels; and wherein driving the pixel circuit to emit the light according to the compensation data voltages of the drive transistor at the plurality of different gray levels comprises:

driving the pixel circuit to emit the light according to the compensation data voltages of the drive transistor at all the gray levels.

9. The method according to claim 2, wherein driving the pixel circuit to emit the light according to the compensation data voltages of the drive transistor at the plurality of different gray levels comprises:

controlling the data voltage write transistor and the threshold compensation transistor to turn on and writing a compensation data voltage of the drive transistor at one gray level of the plurality of different gray levels to the gate of the drive transistor through the data signal line; and controlling the first light emission control transistor and the second light emission control transistor to turn on and driving the light emission device to emit light.

10. The method according to claim 1, wherein the gate of the drive transistor is connected to an analog-to-digital converter; and wherein reading the current gate potential of the drive transistor comprises:

reading the gate potential of the drive transistor through the analog-to-digital converter.

11. The method according to claim 2, wherein the data voltage write transistor, the threshold compensation transistor, the first light emission control transistor, the second light emission control transistor, the first initialization transistor, the second initialization transistor and the drive transistor are P-type field effect transistors.

12. The method according to claim 4, wherein the plurality of different gray level voltages comprise gray level voltages of gray levels (GLs) GL255, GL128, GL64, GL32 and GL0.

13. The method according to claim 8, wherein computing the deviation values of the threshold voltages of the drive transistor at all the gray levels according to the theoretical threshold voltage of the drive transistor and the actual threshold voltages of the drive transistor at the plurality of different gray levels comprises:

fitting a correspondence relationship curve indicating a correspondence relationship between gray level voltages and actual threshold voltages of the drive transistor according to a plurality of different classic gray level voltages and a plurality of actual threshold voltages of the drive transistor in one-to-one correspondence with the plurality of different classic gray level voltages;

obtaining the actual threshold voltages of the drive transistor at all the gray levels according to the correspondence relationship curve; and computing the deviation values of the threshold voltages of the drive transistor at all the gray levels according to the theoretical threshold voltage of the drive transistor and the actual threshold voltages of the drive transistor at all the gray levels.

* * * * *